US009728331B2

(12) United States Patent
Hsieh et al.

(10) Patent No.: US 9,728,331 B2
(45) Date of Patent: Aug. 8, 2017

(54) METHOD FOR MAKING A CHOKE

(71) Applicant: CYNTEC CO., LTD., Hsinchu (TW)

(72) Inventors: Lan-Chin Hsieh, Kaohsiung (TW); Roger Hsieh, Hsinchu County (TW); Yu-Ching Kuo, Miaoli County (TW); Chun-Tiao Liu, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 253 days.

(21) Appl. No.: 14/565,428

(22) Filed: Dec. 10, 2014

(65) Prior Publication Data

US 2015/0089795 A1 Apr. 2, 2015

Related U.S. Application Data

(62) Division of application No. 12/642,327, filed on Dec. 18, 2009, now abandoned.

(30) Foreign Application Priority Data

Jun. 8, 2009 (TW) ..... 98119066 A

(51) Int. Cl.

| | |
|---|---|
| ***H01F 41/04*** | (2006.01) |
| ***H01F 41/00*** | (2006.01) |
| ***H01F 3/10*** | (2006.01) |
| ***H01F 17/04*** | (2006.01) |
| ***H01F 27/02*** | (2006.01) |

(52) U.S. Cl.

CPC ..... *H01F 41/005* (2013.01); *H01F 3/10* (2013.01); *H01F 17/04* (2013.01); *H01F 17/045* (2013.01); *H01F 27/022* (2013.01); *H01F 2017/048* (2013.01); *Y10T 29/49073* (2015.01)

(58) Field of Classification Search

CPC ..... H07R 43/00; H07R 43/21; H07R 43/24; Y10T 29/49002; Y10T 29/49007; Y10T 29/49073; H01F 3/10; H01F 17/04; H01F 17/045; H01F 27/022; H01F 41/005; H01F 2017/048

See application file for complete search history.

(56) References Cited

U.S. PATENT DOCUMENTS

| | | | | |
|---|---|---|---|---|
| 3,675,174 A * | 7/1972 | Horbach | ..... | H01F 41/127 335/299 |
| 4,268,810 A * | 5/1981 | Iwasa | ..... | H01F 41/122 264/103 |
| 4,553,320 A * | 11/1985 | Bryant-Jeffries | ..... | H02K 3/00 29/598 |
| 6,927,658 B2 * | 8/2005 | Okamoto | ..... | H01F 17/045 336/192 |
| 6,950,002 B2 * | 9/2005 | Sano | ..... | H01F 17/045 336/65 |
| 7,898,375 B2 * | 3/2011 | Kitajima | ..... | H01F 17/045 336/185 |

* cited by examiner

*Primary Examiner* — Carl Arbes
(74) *Attorney, Agent, or Firm* — Min-Lee Teng; Litron Patent & Trademark Office

(57) ABSTRACT

A method to form a choke is disclosed, wherein the method comprises: encapsulating a hollow coil by a molding body; forming a first core, wherein the first core comprises a pillar; and disposing at least one first portion of the pillar inside the encapsulated hollow coil. The method avoids the overflow or vertical flow issue during a molding process for encapsulating a coil that has been wound on a core already.

20 Claims, 21 Drawing Sheets

METHOD FOR MAKING A CHOKE

CROSS-REFERENCE TO RELATED APPLICATION

This application is a divisional of U.S. application Ser. No. 12/642,327, filed Dec. 18, 2009, which claims the priority benefit of Taiwan application serial no. 98119066, filed on Jun. 8, 2009. Each of the above-mentioned patent applications is hereby incorporated by reference herein and made a part of this specification.

BACKGROUND OF THE INVENTION

1. Field of the Invention

The present invention generally relates to a passive device, in particular, to a choke.

2. Description of Related Art

A choke functions to stabilize a current in a circuit and achieve the effect of filtering noises. The function of the choke is similar to that of a capacitor, i.e., both for regulating the stability of the current by storing and releasing electric energy in the circuit. Compared with the capacitor that stores electric energy in the form of an electric field (charges), the choke achieves the same purpose in the form of a magnetic field.

FIG. 1 is a schematic top view of a conventional choke. Referring to FIG. 1, the conventional choke 100 has a toroidal core 110 and a wire 120 wound around the toroidal core 110. A fabrication method of the choke 100 is described as follows. First, a magnetic powder (not shown) is press-fit into the toroidal core 110. Then, the toroidal core 110 is fired at a temperature above 600° C. Afterwards, the wire 120 is wound around the toroidal core 110 manually. As the choke 100 needs to be produced by winding the wire 120 on the toroidal core 110 manually instead of being produced automatically, the manufacturing process of the choke 100 requires a considerable labor cost.

Another type of choke is a combined choke, in which a combined core is assembled by an adhesive. However, if the control of the amount of the adhesive is undesirable or the surface of an assembling face of the core is uneven in the assembly, the thickness of the adhesive after the assembly may easily become non-uniform, thus resulting in a large inductance value variation of the choke and obtaining a low yield. In order to solve the above problem, a special surface treatment procedure is proposed for enhancing the assembly precision and enlarging the assembling face of the core, but the manufacturing cost of the choke is increased accordingly.

SUMMARY OF THE INVENTION

Accordingly, the present invention is directed to a choke having high assembly stability and a small inductance value variation.

The present invention is also directed to a choke, in which a wire is wound into a hollow coil by using an automatic equipment, so as to effectively reduce the labor cost consumed in the winding process of the wire.

The present invention is further directed to a choke capable of matching different coils by controlling a position of a second core body relative to a first core body so as to adjust the inductance, such that chokes having different inductances may use the same core, thereby saving the mold cost.

The present invention is further directed to a choke having wire grooves capable of effectively reducing an appearance width of the choke, narrowing a distance between end portions of a coil, and decreasing a pad pitch on a circuit board.

The present invention is further directed to a choke, in which an opening is disposed on a second core body or a bottom plate having an assembling face, so that a pillar protrudes from the assembling face and the protruding pillar does not affect the appearance of the choke.

The present invention is further directed to a choke having a case, a package, and a magnetic case or a core with side wall portions, in which each can be used to replace a magnetic gel, thereby effectively avoiding the problem of overflow or vertical flow of the magnetic gel.

A choke including a core and a hollow coil is provided. The core includes a first core body and a second core body. The first core body includes a pillar. The second core body is a flat plate and has an opening. An end of the pillar is suitable to be disposed in the opening and joined to the same. The hollow coil is fitted on the pillar.

In an embodiment of the present invention, the second core body has a joining face and an assembling face opposite to the joining face. The end of the pillar is suitable to be disposed in the opening from the joining face. The opening is located at a center of the second core body and in communication with the joining face and the assembling face.

In an embodiment of the present invention, the end of the pillar is substantially aligned with the assembling face.

In an embodiment of the present invention, the end of the pillar passes through the opening and protrudes from the assembling face.

In an embodiment of the present invention, the hollow coil has two end portions disposed on the assembling face.

In an embodiment of the present invention, the second core body further has two wire grooves located at edges of the second core body. The end portions pass through the wire grooves.

In an embodiment of the present invention, the choke further includes a material layer disposed on an inner wall of the opening and located between the pillar and the opening.

In an embodiment of the present invention, the material layer is a magnetic gel.

In an embodiment of the present invention, the first core body further includes a top plate connected to an end of the pillar. The pillar and the top plate are integrally formed. The hollow coil is located between the top plate of the first core body and the second core body.

In an embodiment of the present invention, the choke further includes a magnetic gel encapsulating the hollow coil.

In an embodiment of the present invention, the choke further includes a magnetic gel and a case with an opening end. The case is of a barrel-shaped structure. The core and the hollow coil are disposed in the case. The second core body is disposed at the opening end and an assembling face of the second core body is exposed out of the opening end. The magnetic gel is disposed in a space between the case and the hollow coil.

In an embodiment of the present invention, the second core body further has at least one injection hole located at an edge of the second core body. The magnetic gel is suitable to be filled in the case through the injection hole.

In an embodiment of the present invention, the choke further includes a package fitted on the pillar of the first core body. The package includes the hollow coil and a magnetic material encapsulating the hollow coil.

In an embodiment of the present invention, the choke further includes a magnetic case having two opening ends, an upper surface, and a lower surface opposite to the upper surface. The opening ends are respectively located at the upper surface and the lower surface and in communication with each other. The hollow coil is disposed in the magnetic case. The pillar of the first core body penetrates through the opening ends of the magnetic case. The second core body is disposed on the lower surface of the magnetic case.

In an embodiment of the present invention, the first core has a top plate connected to an end of the pillar. The top plate of the first core body has a bottom portion and two side wall portions. The side wall portions are disposed at two opposite side edges of the bottom portion, and an extension direction of the side wall portions is substantially perpendicular to that of the bottom portion.

In an embodiment of the present invention, the second core body is disposed between the side wall portions.

In an embodiment of the present invention, the second core body is directly disposed on the hollow coil.

A choke including a core, at least one wire, and a case is provided. The core has a pillar. The wire is wound around the pillar of the core. The case is of a barrel-shaped structure with an opening end. The core and the wire are disposed in the case. The opening end exposes an assembling face of the core.

In an embodiment of the present invention, the core includes a top plate and a bottom plate having the assembling face. The pillar is disposed between the top plate and the bottom plate. A winding space is formed between the top plate, the bottom plate, and the pillar. The wire is located in the winding space.

In an embodiment of the present invention, the core includes a bottom plate having the assembling face. The bottom plate has at least one injection hole located at an edge of the bottom plate. The magnetic gel is suitable to be filled in the case through the injection hole.

In an embodiment of the present invention, the core includes a pillar and a bottom plate having the assembling face. The bottom plate has an opening. An end of the pillar is suitable to be disposed in the opening and joined to the same. The wire is a hollow coil fitted on the pillar.

In an embodiment of the present invention, the bottom plate is directly disposed on the hollow coil.

A choke including a core and a package is provided. The core includes a pillar. The package is fitted on the pillar of the core, and includes a hollow coil and a magnetic material encapsulating the hollow coil.

In an embodiment of the present invention, in the package, the magnetic material encapsulates the hollow coil by means of injection molding or press molding.

In an embodiment of the present invention, the core further includes a top plate. The pillar and the top plate are integrally formed. An end of the pillar is fitted in the package.

In an embodiment of the present invention, the core further includes a top plate. The pillar and the top plate are integrally formed. An end of the pillar passes through the package and is substantially aligned with a surface of the package away from the top plate.

In an embodiment of the present invention, the core further includes a top plate and a bottom plate. The top plate and the pillar are integrally formed. An end of the pillar passes through the package and is substantially aligned with a surface of the package away from the top plate. The bottom plate covers an end of the pillar and the surface of the package.

In an embodiment of the present invention, the core further includes a top plate and a bottom plate. The top plate and the pillar are integrally formed. The bottom plate has an opening, a joining face, and an assembling face opposite to the joining face. An end of the pillar passes through the package and is disposed in the opening from the joining face, and the end of the pillar is substantially aligned with the assembling face.

A choke including a core and a hollow coil is provided. The coil includes a first core body and a second core body. The first core body includes a top plate and a pillar. The top plate has a bottom portion and a side wall portion. The side wall portion is disposed around the bottom portion, and an extension direction of the side wall portion is substantially perpendicular to that of the bottom portion. The side wall portion surrounds the pillar. The second core body is a flat plate and has an opening. An end of the pillar is suitable to be disposed in the opening. The hollow coil is fitted on the pillar and located between the top plate of the first core body and the second core body. A height of the hollow coil is smaller than that of the side wall portion of the top plate. The side wall portion at least contacts a part of the hollow coil.

In an embodiment of the present invention, the pillar and the top plate are integrally formed.

In an embodiment of the present invention, the second core body has a joining face and an assembling face opposite to the joining face. The end of the pillar is suitable to be disposed in the opening from the joining face. The opening is located at a center of the second core body and in communication with the joining face and the assembling face.

In an embodiment of the present invention, the end of the pillar is substantially aligned with the assembling face.

In an embodiment of the present invention, the end of the pillar passes through the opening and protrudes from the assembling face.

In an embodiment of the present invention, the first core body further includes at least one wire groove disposed at the side wall portion of the top plate.

In an embodiment of the present invention, the choke further includes a material layer disposed on an inner wall of the opening and located between the pillar and the opening.

In an embodiment of the present invention, the second core body is directly disposed on the hollow coil.

As described above, in the choke of the present invention, a wire is first wound into a hollow coil by using an automatic equipment, then the hollow coil is fitted on a pillar of a first core body, and an end of the pillar is disposed in an opening of a second core body. Thereby, the hollow coil is located between a top plate of the first core body and the second core body, and the assembly of the choke is completed. Compared with the conventional art, the choke of the present invention can not only effectively reduce the labor cost consumed in the winding process of the wire, but also enhance the assembly stability and reduce the inductance value variation.

In order to make the aforementioned and other objectives, features, and advantages of the present invention comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
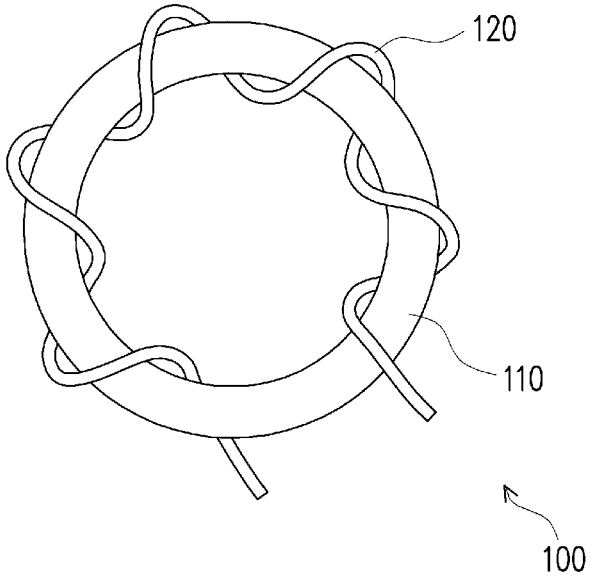
FIG. 1 (RELATED ART)
FIG. 1 is a schematic top view of a conventional choke.

Reference will now be made in detail to the present embodiments of the invention, examples of which are illustrated in the accompanying drawings. Wherever possible, the same reference numbers are used in the drawings and the description to refer to the same or like parts.

Figure 2A:
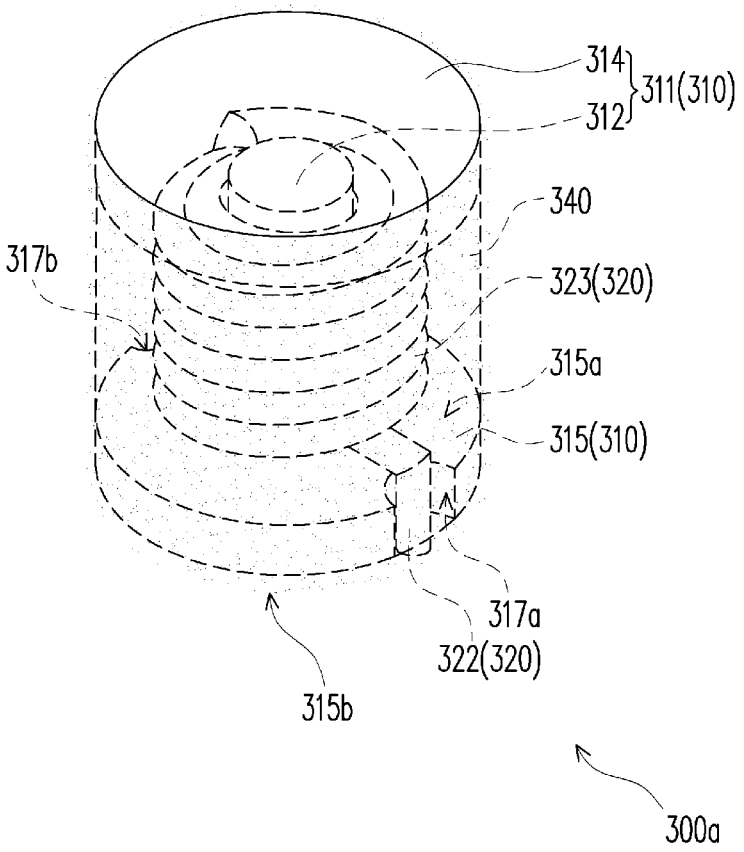
FIG. 2A is a schematic view of a choke according to an embodiment of the present invention.
Figure 2B:
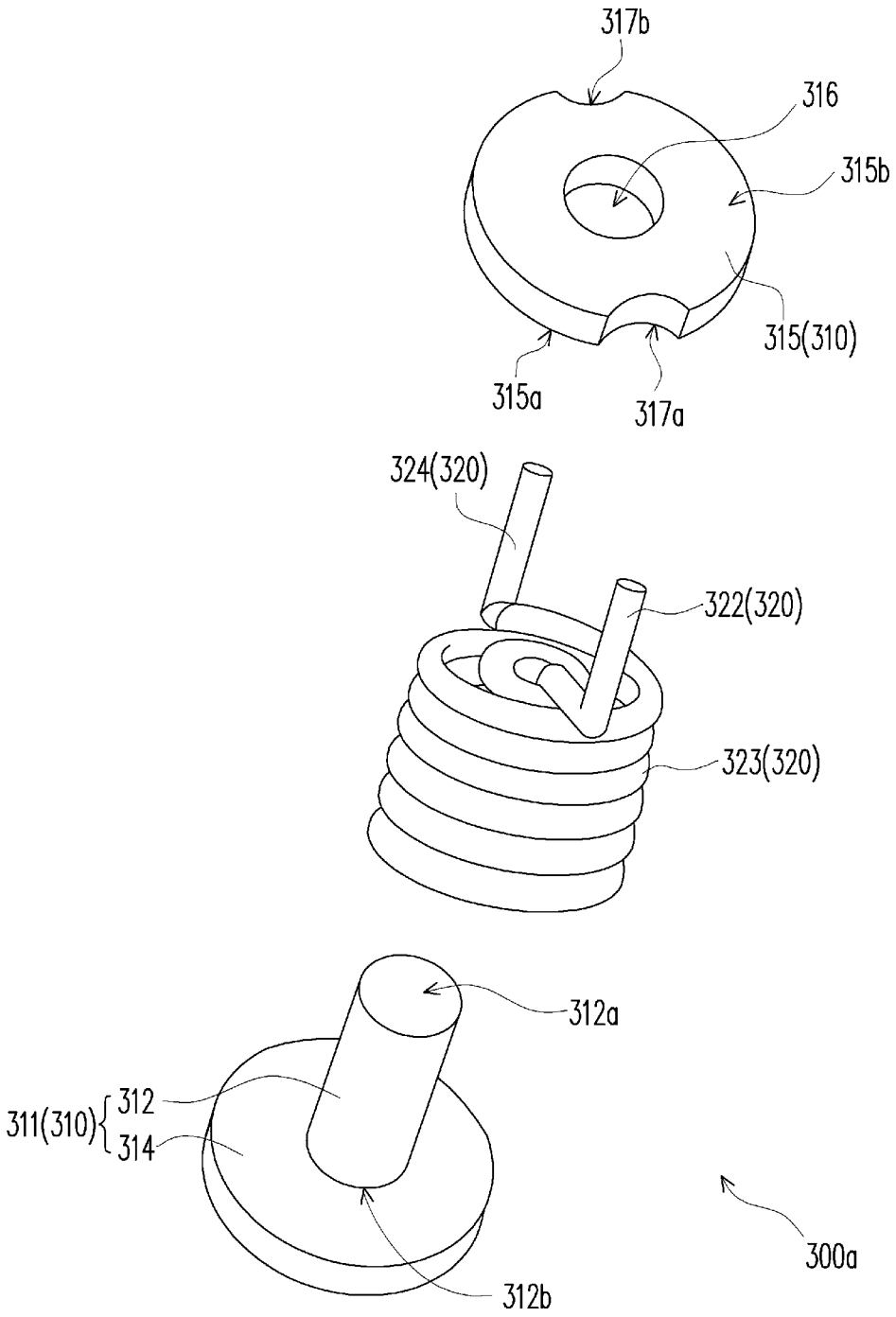
FIG. 2B is a schematic exploded view of the choke in FIG. 2A.
Figure 2C:
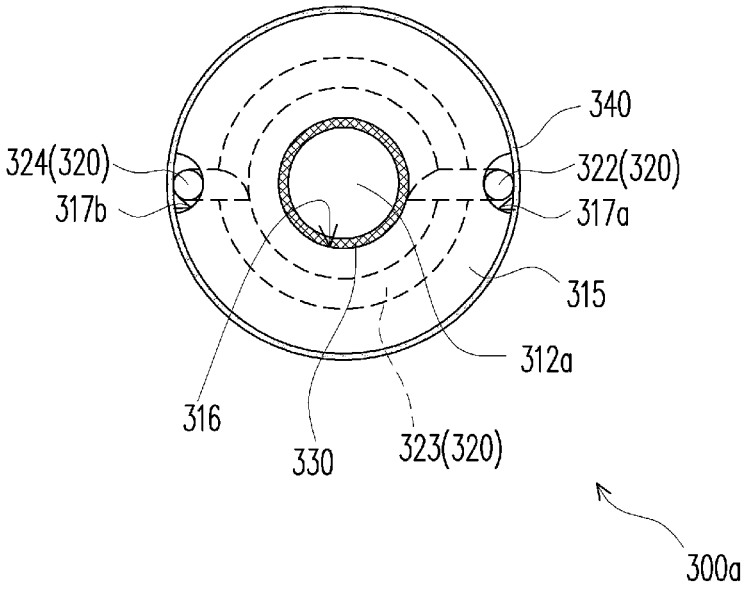
FIG. 2C is a schematic bottom view of the choke in FIG. 2A.

FIG. 2A is a schematic view of a choke according to an embodiment of the present invention, FIG. 2B is a schematic exploded view of the choke in FIG. 2A, and FIG. 2C is a schematic bottom view of the choke in FIG. 2A. First referring to FIGS. 2A and 2B, in this embodiment, the choke 300*a* includes a core 310 and a hollow coil 320. The core 310 includes a first core body 311 and a second core body 315.

The first core body 311 includes a pillar 312 and a top plate 314. An end 312*b* of the pillar 312 is connected to the top plate 314 to form a T-shaped structure. The pillar 312 and the top plate 314 are integrally formed. The second core body 315 is a flat plate and has a joining face 315*a*, an assembling face 315*b* opposite to the joining face 315*a*, an opening 316, and two wire grooves 317*a* and 317*b* disposed at two opposite side edges of the opening 316 and located at edges of the second core body 315. The opening 316 is located at a center of the second core body 315 and in communication with the joining face 315*a* and the assembling face 315*b*. An end 312*a* of the pillar 312 of the first core body 311 is suitable to be disposed in the opening 316 from the joining face 315*a* and joined to the opening 316. The end 312*a* of the pillar 312 may be joined to the opening 316 by means of close-fit joining or adhesive bonding. In this embodiment, the top plate 314, the second core body 315, and the opening 316 all have a round cross-section, and the pillar 312 is a cylinder, but the present invention is not limited thereto. For example, the top plate 314, the second core body 315, and the opening 316 may also be rectangular, and the pillar 312 is a rectangular prism.

The core 310 is made of a ferrite material, iron, or a low magnetic loss material. The ferrite material includes Ni—Zn ferrite or Mn—Zn ferrite. The low magnetic loss material is, for example, an iron-containing alloy including a FeAlSi alloy, a FeNiMo alloy, a Fe—Ni alloy, or an amorphous alloy. It should be noted that, by using a low magnetic loss material to form the core 310 may enhance the magnetic permeability and achieve low magnetic loss. In this embodiment, the first core body 311 and the second core body 315 of the core 310 are made of a ferrite material, and the magnetic permeability of the core 310 is, for example, above 75. In particular, the core 310 is formed by pressing and firing a ferrite powder mixed with a binder. The binder includes a polymethylallyl (PMA) synthesize resin.

It should be noted herein that, in the manufacturing process of the first core body 311 and the second core body 315, a spacing may be easily produced at a junction between the pillar 312 and the opening 316 due to the influence of a process tolerance, i.e., referring to FIG. 2C, a diameter of the opening 316 is larger than that of the pillar 312. Therefore, in this embodiment, a material layer 330 is selectively coated on an inner wall of the opening 316, i.e., the material layer 330 is located between the pillar 312 and the opening 316, so as to reduce the impact of the spacing between the pillar 312 and the opening 316 on the inductance value in the assembly, thereby enhancing the assembly stability and reducing the inductance value variation. In addition, the material layer 330 is, for example, a resin gel or a magnetic gel. It should be noted that, the material layer 330 may be directly used as an adhesive for bonding the end 312*a* of the pillar 312 to the opening 316.

The hollow coil 320 is fitted on the pillar 312 of the first core body 311 and located between the top plate 314 of the first core body 311 and the joining face 315*a* of the second core body 315. In particular, in this embodiment, a wire is wound into the hollow coil 320 by using an automatic equipment. The wire is, for example, a round wire (having a round minimum cross-section) or a flat wire (having a rectangular minimum cross-section), and is formed by, for example, a copper wire encapsulated with an enamel coating as an insulating layer. Specifically, the hollow coil 320 has two end portions 322 and 324 and a winding portion 323 located between the two end portions 322 and 324, the winding portion 323 is wound around the pillar 312 of the first core body 311, and the two end portions 322 and 324 pass through the wire grooves 317*a* and 317*b* of the second core body 315 and are disposed on the assembling face 315*b*. The two end portions 322 and 324 of the hollow coil 320 may be used as external electrodes directly or by connecting a lead frame. The external electrodes may be electrically connected to an external circuit by means of through-hole mount or surface mount.

Figure 3:
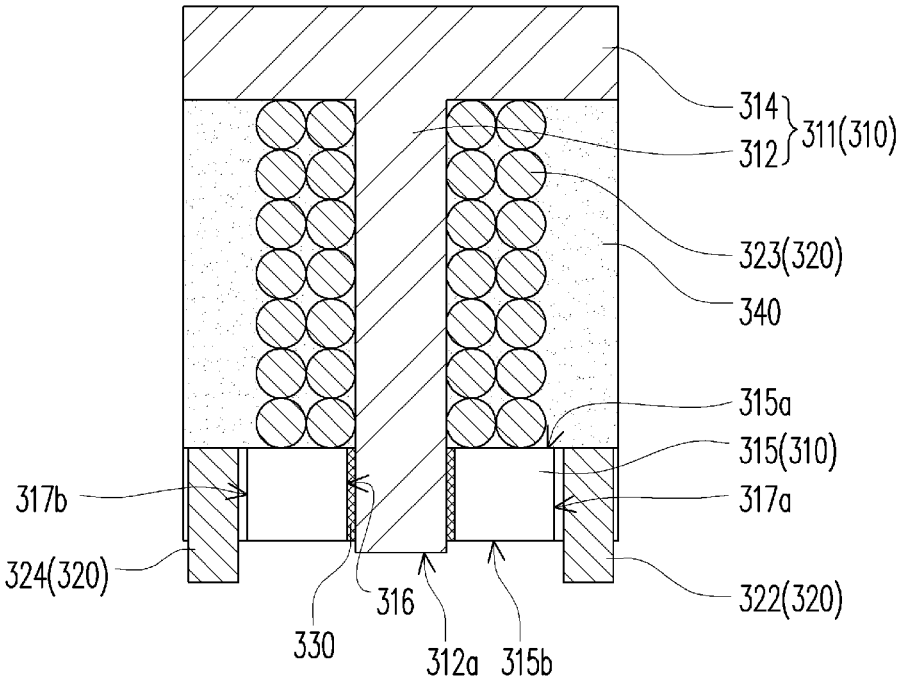
FIG. 3 is a schematic cross-sectional view of a choke according to another embodiment of the present invention.

It should be noted that, the second core body 315 is directly press-fit on the hollow coil 320, and thus directly disposed on the hollow coil 320, so that the second core body 315 can be positioned through a height of the hollow coil 320. In this embodiment, the end 312*a* of the pillar 312 of the first core body 311 is substantially aligned with the assembling face 315*b* of the second core body 315; however, in another embodiment, referring to FIG. 3, the end 312*a* of the pillar 312 of the first core body 311 passes through the opening 316 of the second core body 315 and protrudes from the assembling face 315*b*, which is still a technical solution applicable in the present invention without departing from the scope of the invention. In FIG. 3, a height of the pillar 312 protruding from the assembling face 315*b* is smaller than a length of the two end portions 322 and 324 of the hollow coil 320 extending out of the wire grooves 317*a* and 317*b*, so as to prevent the pillar 312 from affecting electrical connections between the end portions 322, 324 and the external circuit.

In addition, in the choke 300*a* of this embodiment, a magnetic gel 340 may be selectively filled between the first core body 311 and the second core body 315, and encapsulate the winding portion 323 and a part of the end portions 322 and 324 of the hollow coil 320, such that the end portions 322 and 324 that are not encapsulated are used for electrical connections to the external circuit. The magnetic gel 340 includes a resin material and a magnetic powdery material. The magnetic powdery material accounts for over 70 percent of a total weight of the magnetic gel 340, and the magnetic permeability of the magnetic gel 340 is, for example, but not limited to, above 6. The resin material may be selected from a group consisting of polyamide 6 (PA6), polyamide 12 (PA12), polyphenylene sulfide (PPS), polybutyleneterephthalate (PBT), and ethylene-ethyl acrylate copolymer (EEA). The magnetic powdery material may be a metal soft magnetic material or ferrite powder. The metal soft magnetic material may be selected from a group consisting of iron, FeAlSi alloy, FeCrSi alloy, and stainless steel.

In the choke 300*a* of this embodiment, the wire is first wound into the hollow coil 320 by using the automatic equipment, then the hollow coil 320 is fitted on the pillar 312 of the first core body 311, and the end 312*a* of the pillar 312 is disposed in the opening 316 of the second core body 315, so as to complete the assembly. Compared with the conventional choke 100, the choke 300*a* of this embodiment can effectively reduce the labor cost consumed in the winding process of the wire.

Further, in the present invention, different hollow coils can be applied by controlling a position of the second core body 315 relative to the first core body 311 so as to adjust the inductance, such that chokes having different inductances may use the same core, thereby saving the mold cost. Moreover, the opening 316 is disposed on the second core body 315 having the assembling face 315*b*, and thus the pillar 312 protrudes from the assembling face 315*b* without affecting the appearance of the choke 300*a* when the inductance value is adjusted through the position of the second core body 315. In addition, as the second core body 315 has the wire grooves 317*a* and 317*b* for the two end portions 322 and 324 of the hollow coil 320 to pass through, a distance between the two end portions 322 and 324 and an appearance width of the choke 300*a* can be reduced, and a pad pitch on a circuit board can be effectively decreased when the two end portions 322 and 324 are used as external electrodes.

Figure 4:
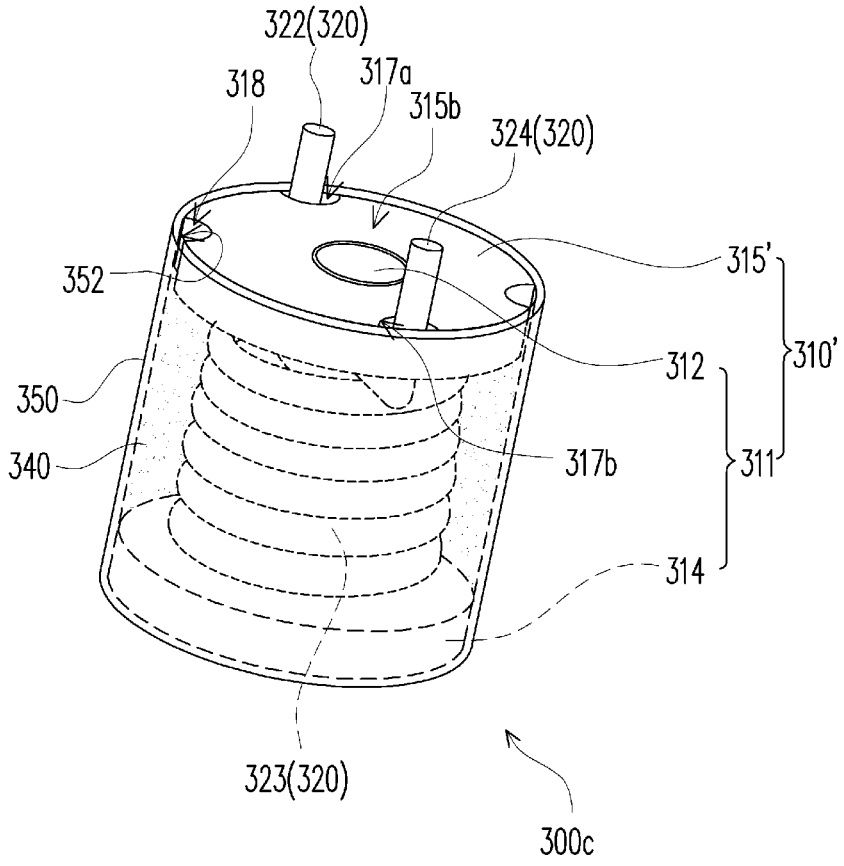
FIG. 4 is a schematic three-dimensional view of a choke according to another embodiment of the present invention.

FIG. 4 is a schematic three-dimensional view of a choke according to another embodiment of the present invention. Referring to FIGS. 2A and 4, the choke 300*c* in FIG. 4 is similar to the choke 300*a* in FIG. 2A. The differences lie in that: the choke 300*c* in FIG. 4 further includes a case 350 having an opening end 352, and a second core body 315' further includes at least one injection hole 318 (two injection holes are shown in FIG. 4) located at an edge of the second core body 315'. The case 350 is of a barrel-shaped structure. A core 310' and the hollow coil 320 are disposed in the case 350. The second core body 315' is disposed at the opening end 352, and the opening end 352 exposes the assembling face 315*b* of the second core body 315'. The magnetic gel 340 is suitable to be filled in the case 350 through the injection holes 318, so as to be disposed in a space between the case 350 and the hollow coil 320 and encapsulate the hollow coil 320, the pillar 312 and the top plate 314 of the first core body 311, and a part of the second core body 315'.

As the choke 300*c* of this embodiment has the case 350, the problem of overflow or vertical flow may not occur when the magnetic gel 340 is filled in (especially when the height of the choke 300*c* is greater, for example, above 10 mm), the appearance of the choke 300*c* is nice and cracks (on the surface of the choke caused by different thermal expansion coefficients of the resin material and the copper wire) of the magnetic gel 340 can be hidden, and the choke 300*c* is also prevented from rusting. Besides, if the case 350 is made of a metal or magnetic material, the choke 300*c* is free from electromagnetic interference. If the case 350 is made of a metal, heat is dissipated to lower the bulk temperature of the choke 300*c*, thereby improving the efficiency thereof.

Figure 5:
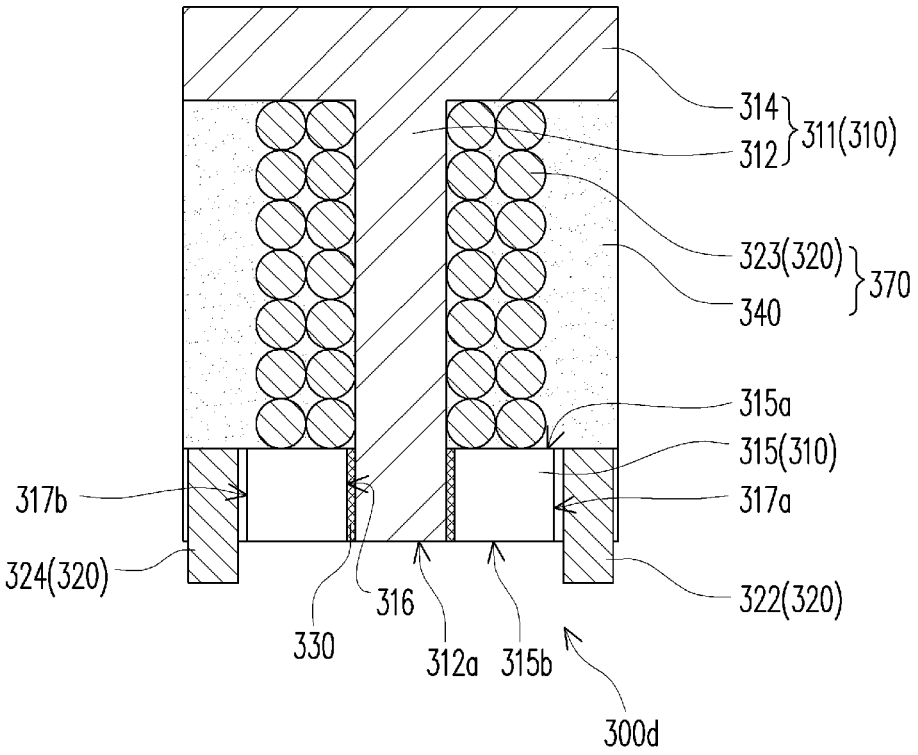
FIG. 5 is a schematic cross-sectional view of a choke according to another embodiment of the present invention.

FIG. 5 is a schematic cross-sectional view of a choke according to another embodiment of the present invention. Referring to FIGS. 2A and 5, the choke 300*d* in FIG. 5 is similar to the choke 300*a* in FIG. 2A. The difference lies in that: in the fabrication of the choke 300*d* in FIG. 5, the magnetic gel 340 first encapsulates the hollow coil 320 by means of injection molding or press molding to form a package 370, and then the package 370 is fitted on the pillar 312, so that the end 312*a* of the pillar 312 of the first core body 311 passes through the hollow coil 320 and the second core body 315 and is aligned with the assembling face 315*b* of the second core body 315, thereby completing the assembly of the choke 300*d*. As in the fabrication of the choke 300*d* of this embodiment, the magnetic gel 340 first encapsulates the hollow coil 320 to form the package 370 and is then assembled on the core 310, the problem of overflow or vertical flow can be avoided. Moreover, the magnetic gel is formed by means of injection molding and press molding, so that the density of the magnetic gel in the package 370 is increased, thus enhancing the magnetic permeability. Therefore, under the condition of achieving the same inductance value, the choke 300*d* has a smaller volume than that of the chokes 300*a* and 300*c*.

Figure 6A:
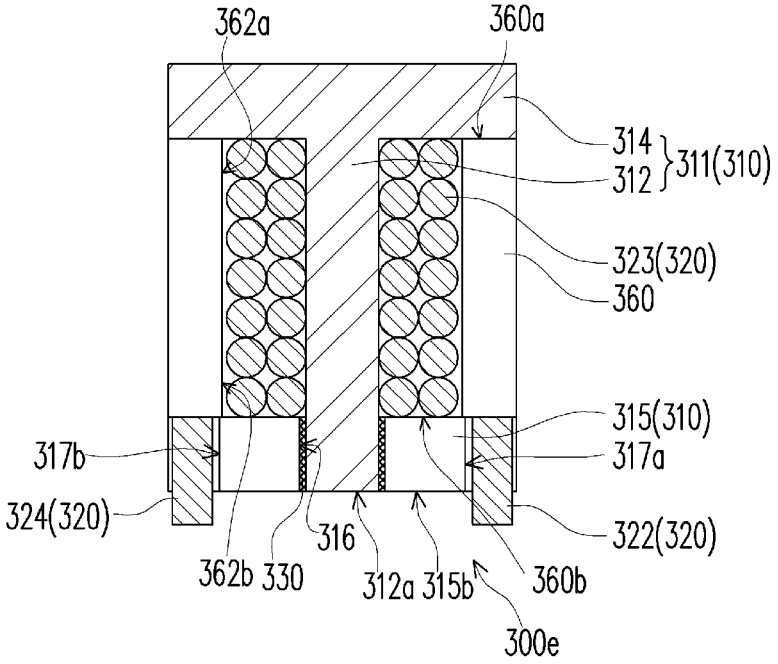
FIG. 6A is a schematic cross-sectional view of a choke according to another embodiment of the present invention.
Figure 6B:
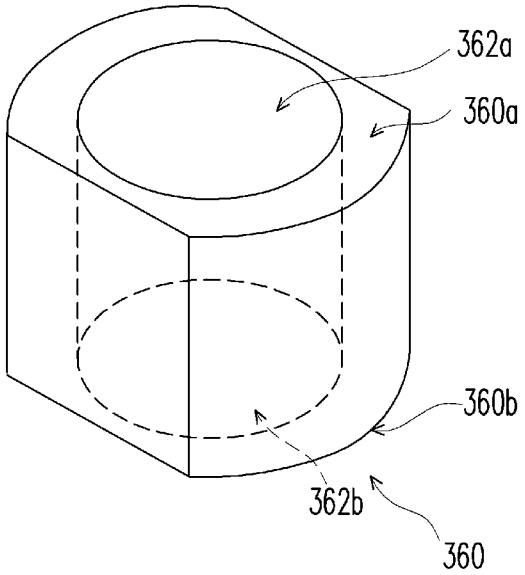
FIG. 6B is a schematic three-dimensional view of a magnetic case in FIG. 6A.

FIG. 6A is a schematic cross-sectional view of a choke according to another embodiment of the present invention, and FIG. 6B is a schematic three-dimensional view of a magnetic case in FIG. 6A. Referring to FIGS. 2A, 6A, and 6B, the choke 300*e* in FIG. 6A is similar to the choke 300*a* in FIG. 2A. The difference lies in that: in the choke 300*e* in FIG. 6A, a magnetic case 360 is adapted to replace the magnetic gel 340 in FIG. 2A. The magnetic case 360 has an upper surface 360*a*, a lower surface 360*b* opposite to the upper surface 360*a*, and two opening ends 362*a* and 362*b*.

The opening ends 362*a* and 362*b* are respectively located at the upper surface 360*a* and the lower surface 360*b* and in communication with each other. In particular, the hollow coil 320 is disposed in the magnetic case 360, and the pillar 312 of the first core body 311 penetrates through the opening ends 362*a* and 362*b* of the magnetic case 360, so that the top plate 314 of the first core body 311 leans against the upper surface 360*a* of the magnetic case 360, and the second core body 315 is disposed on the lower surface 360*b* of the magnetic case 360. As in the choke 300*e* of this embodiment, the magnetic case 360 is adapted to replace the magnetic gel 340, the problem of overflow or vertical flow may not occur.

Figure 7:
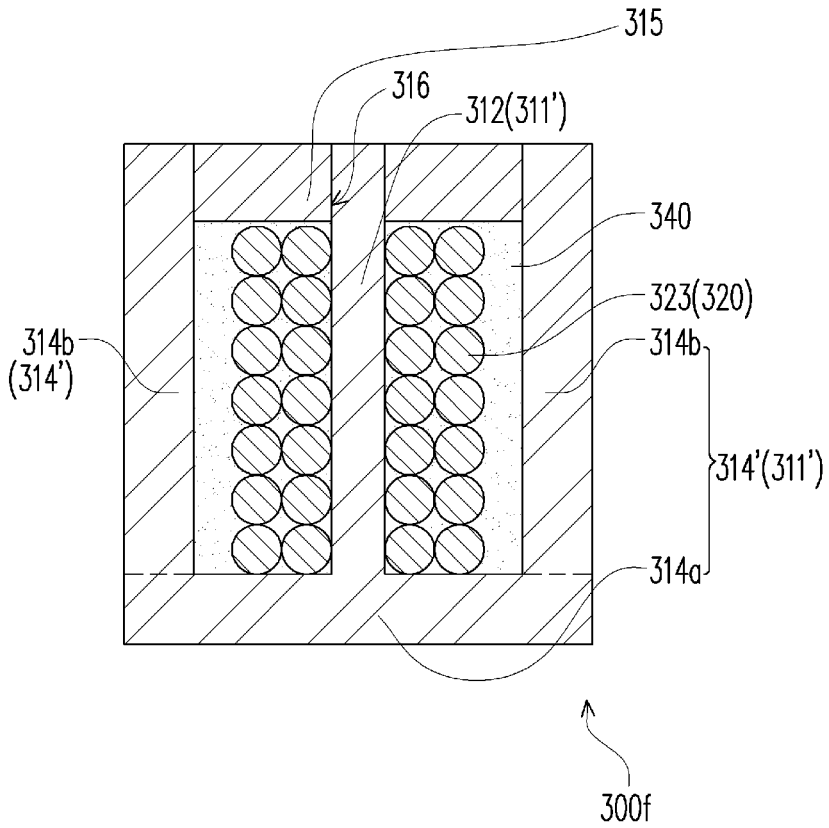
FIG. 7 is a schematic cross-sectional view of a choke according to another embodiment of the present invention.

FIG. 7 is a schematic cross-sectional view of a choke according to another embodiment of the present invention. Referring to FIGS. 2A and 7, the choke 300*f* in FIG. 7 is similar to the choke 300*a* in FIG. 2A. The difference lies in that: a top plate 314' of a first core body 311' of the choke 300*f* in FIG. 7 has a bottom portion 314*a* and two side wall portions 314*b*. The side wall portions 314*b* are disposed at two opposite side edges of the bottom portion 314*a*. An extension direction of the side wall portions 314*b* is substantially perpendicular to that of the bottom portion 314*a* and is parallel to that of the pillar 312. A height of the side wall portions 314*b* may be the same as that of the pillar 312. The second core body 315 is disposed between the side wall portions 314*b*. The magnetic gel 340 is filled between the side wall portions 314*b* of the first core body 311, and encapsulates the winding portion 323 and a part of the end portions (not shown) of the hollow coil 320. In the choke 300*f* of this embodiment, the side wall portions 314*b* are disposed to alleviate the problem of overflow or vertical flow of the magnetic gel 340.

Figure 8A:
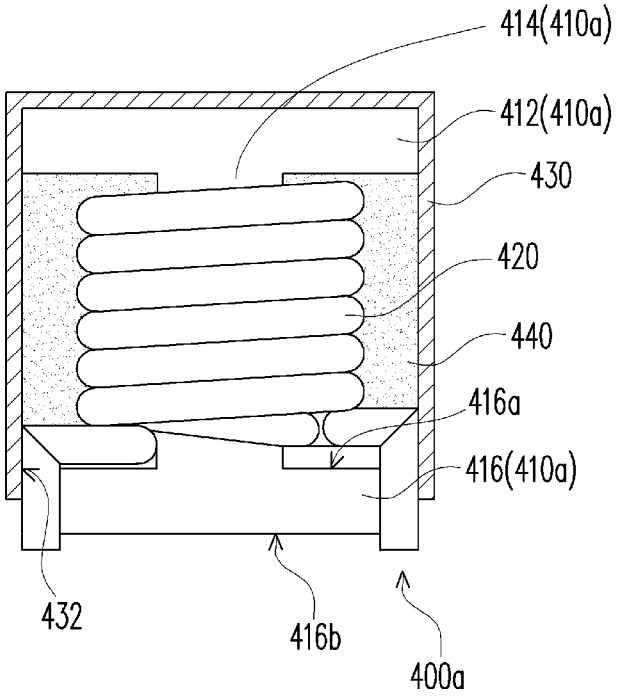
FIG. 8A is a schematic cross-sectional view of a choke according to another embodiment of the present invention.
Figure 8B:
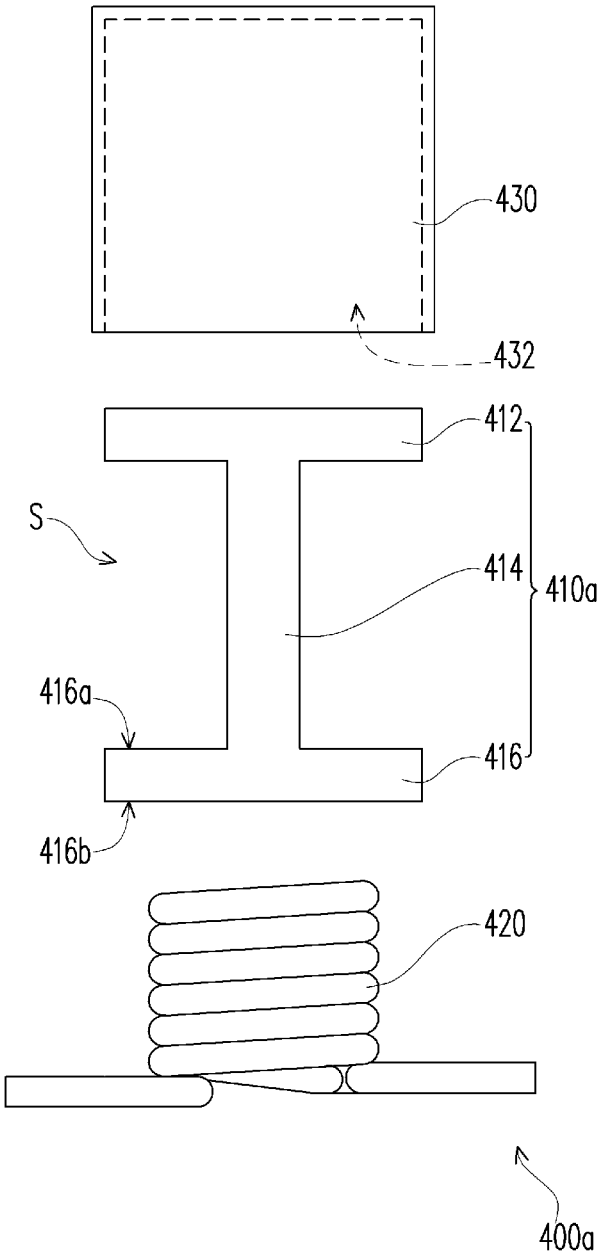
FIG. 8B is a schematic exploded view of the choke in FIG. 8A.
Figure 8C:
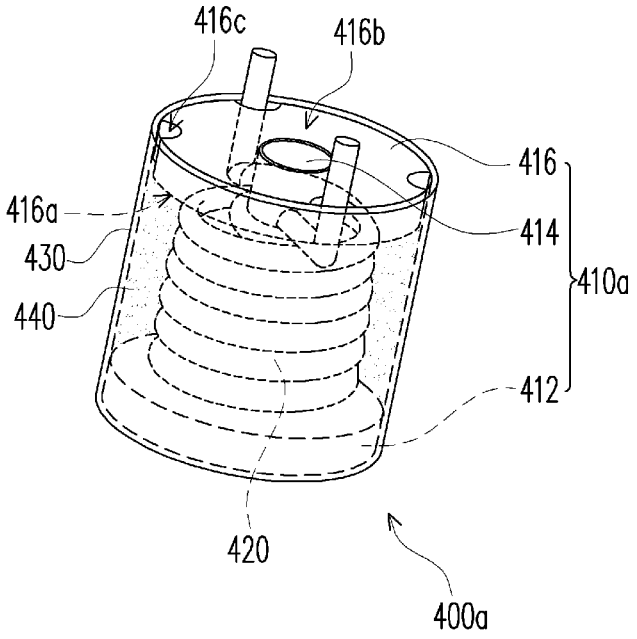
FIG. 8C is a schematic three-dimensional view of the choke in FIG. 8A.

FIG. 8A is a schematic cross-sectional view of a choke according to another embodiment of the present invention, FIG. 8B is a schematic exploded view of the choke in FIG. 8A, and FIG. 8C is a schematic three-dimensional view of the choke in FIG. 8A. It should be noted that, for ease of illustration, the magnetic gel 340 is not shown in FIG. 8B. Referring to FIGS. 8A, 8B, and 8C, in this embodiment, the choke 400*a* includes a core 410*a*, at least one wire 420, and a case 430. In particular, the core 410*a* includes a top plate 412, a pillar 414, and a bottom plate 416. The bottom plate 416 has a joining face 416*a*, an assembling face 416*b* opposite to the joining face 416*a*, and at least one injection hole 416*c* (two injection holes are shown in FIG. 8C). The pillar 414 is disposed between the top plate 412 and the bottom plate 416. A winding space S is formed between the top plate 412, the pillar 414, and the bottom plate 416. The material and fabrication method of the core 410*a* are the same as those of the core 310, and the details thereof will not be described herein again. In this embodiment, the top plate 412, the pillar 414, and the bottom plate 416 of the core 410*a* are integrally formed into a drum-core structure.

The wire 420 is wound around the pillar 414 and located in the winding space S. The wire 420 is, for example, a round wire (having a round minimum cross-section) or a flat wire (having a rectangular minimum cross-section), and is formed by, for example, a copper wire encapsulated with an enamel coating as an insulating layer. Besides, the wire 420 may be wound around the pillar 414 of the core 410*a* by using an automatic equipment. The number of the wire 420 is not limited in this embodiment, i.e., one or more wires 420 may be adopted herein.

The case 430 is of a barrel-shaped structure with an opening end 432. The core 410*a* and the wire 420 are disposed in the case 430. The opening end 432 exposes the assembling face 416*b* of the bottom plate 416 of the core 410*a*.

Moreover, the choke 400*a* of this embodiment further includes a magnetic gel 440 suitable to be filled in the case 430 through the injection holes 416*c*, so as to fill up the winding space S and encapsulate the wire 420 and a part of the core 410*a*. A material of the magnetic gel 440 is the same as that of the magnetic gel 340, and the details thereof will not be described herein again.

As the choke 400*a* of this embodiment has the case 430, the problem of overflow or vertical flow may not occur when the magnetic gel 430 is filled in, the appearance of the choke 400*a* is nice and cracks of the magnetic gel can be hidden, and the choke 400*a* is also prevented from rusting. Besides, if the case 430 is made of a metal or magnetic material, the choke 400*a* is free from electromagnetic interference. If the case 430 is made of a metal, heat is dissipated to lower the bulk temperature of the choke 400*a*, thereby improving the efficiency thereof.

Figure 8D:
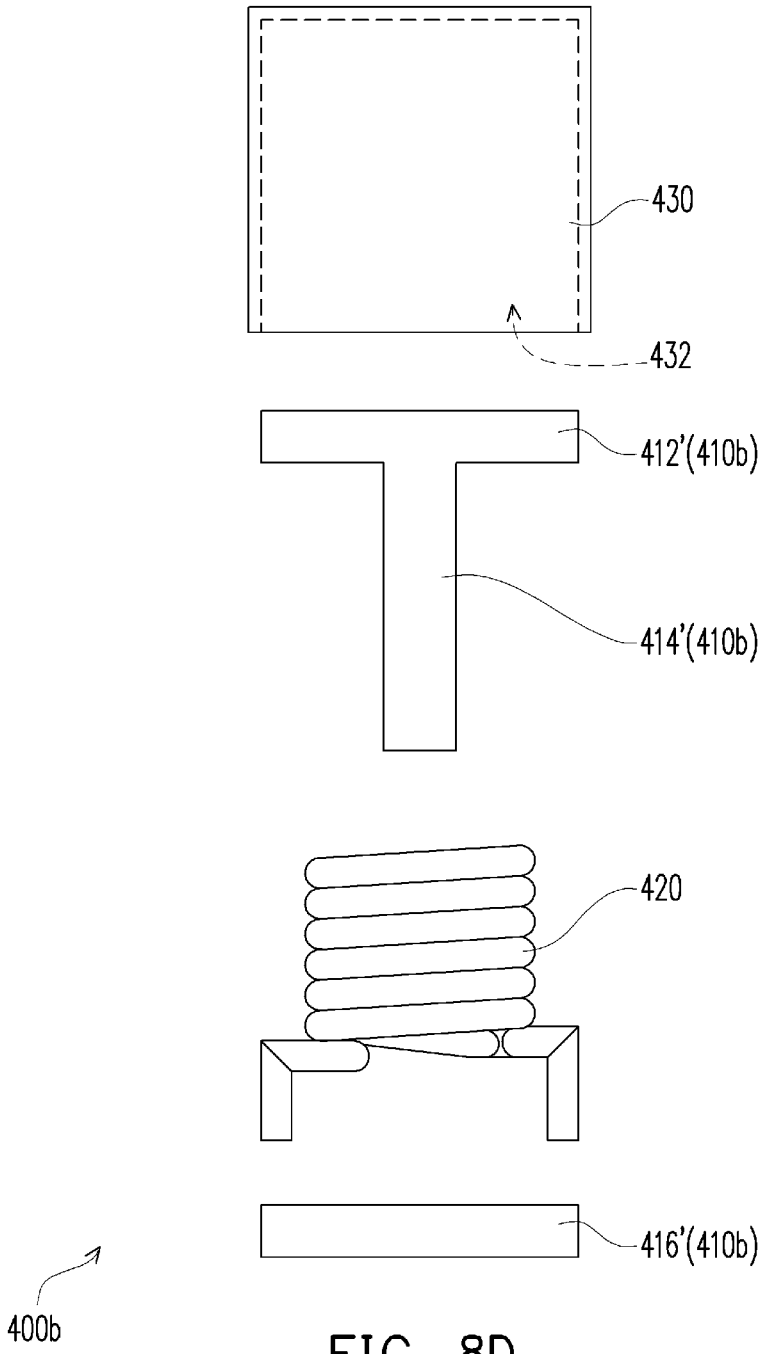
FIG. 8D is another schematic exploded view of the choke in FIG. 8A.
Figure 8E:
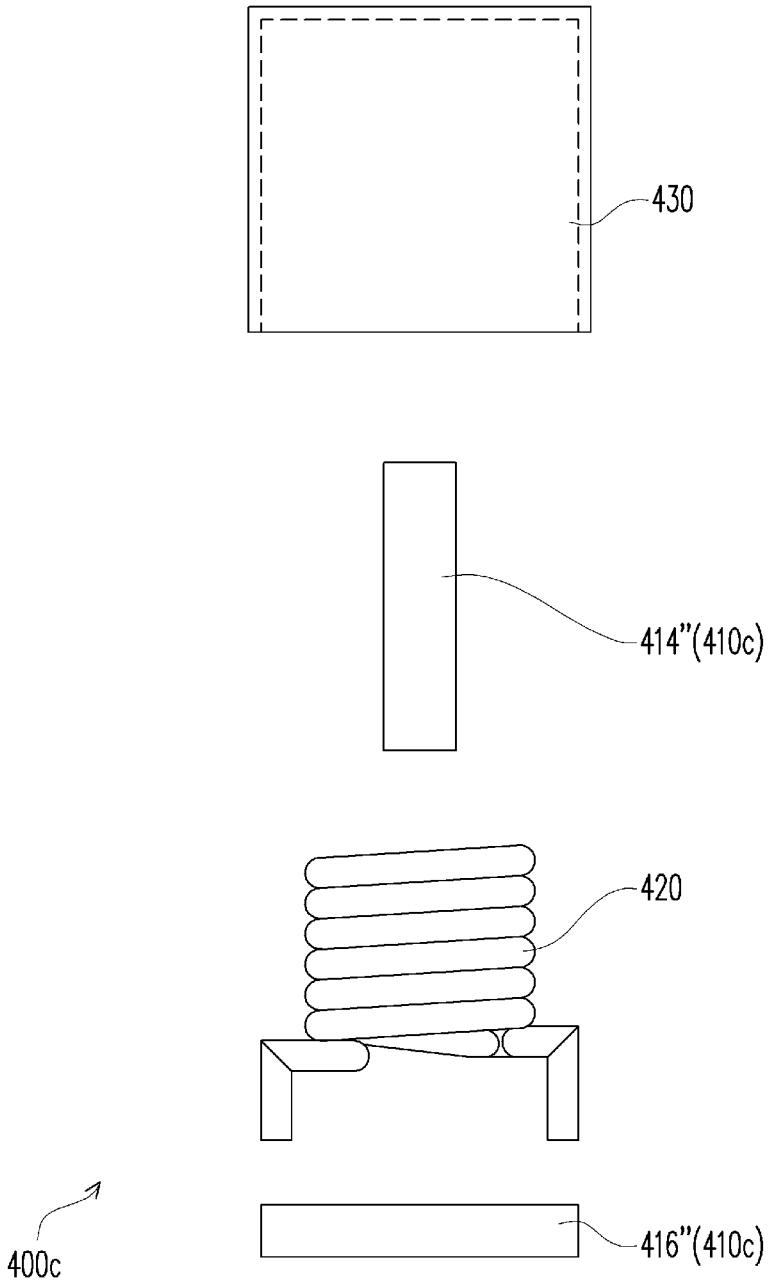
FIG. 8E is a still another schematic exploded view of the choke in FIG. 8A.

It should be noted that, the form of the core 410*a* is not limited in the present invention. In other embodiments, first referring to FIG. 8D, the core 410*b* of the choke 400*b* may also be formed by a top plate 412', a pillar 414', and a bottom plate 416', the pillar 414' and the top plate 412' are integrally formed and the bottom plate 416' is connected to an end of the pillar 414' through adhesive bonding, or the pillar 414', the top plate 412', and the bottom plate 416' are all connected to each other through adhesive bonding, and the wire 420 is a hollow coil fitted on the pillar 414'. Further, referring to FIG. 8E, the core 410*c* of the choke 400*c* may also be formed by a pillar 414" and a bottom plate 416", and the wire 420 is a hollow coil fitted on the pillar 414", which is still a technical solution applicable in the present invention without departing from the scope of the invention.

Figure 9:
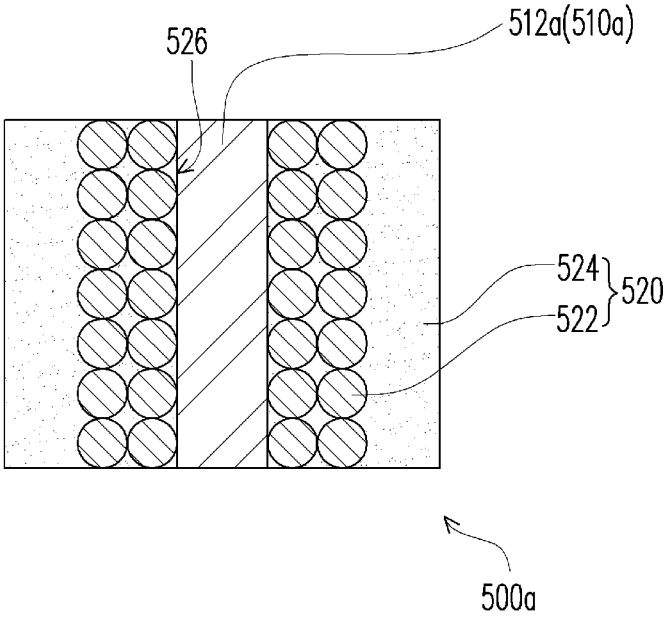
FIG. 9 is a schematic cross-sectional view of a choke according to another embodiment of the present invention.

FIG. 9 is a schematic cross-sectional view of a choke according to another embodiment of the present invention. Referring to FIG. 9, in this embodiment, the choke 500*a* includes a core 510*a* and a package 520. The core 510*a* includes a pillar 512*a*. The package 520 is fitted on the pillar 512*a* of the core 510*a*, and includes a hollow coil 522 and a magnetic material 524 encapsulating the hollow coil 522. The package 520 is formed by encapsulating the magnetic material 524 around the hollow coil 522 by means of injection molding or pressing molding, and has a through-hole 526 for disposing the pillar 512*a* of the core 510*a*. In this embodiment, a height of the package 520 is equal to a length of the pillar 512*b*, so that two ends of the pillar 512*b* are aligned with a surface of the package 520. A material of the core 510*a* is the same as that of the core 310, a material of the hollow coil 522 is the same as that of the hollow coil 320, and a material of the magnetic material 524 is the same as that of the magnetic gel 340, which will not be described herein again.

In the fabrication of the choke 500*a* of this embodiment, the package 520 is formed first, and then the pillar 512*a* of the core 510*a* passes through the hollow coil 522 to form the choke 500*a*. The choke 500*a* of this embodiment may achieve the same efficacies as the choke 300*d*, and the details thereof will not be described herein again.

Figure 10A:
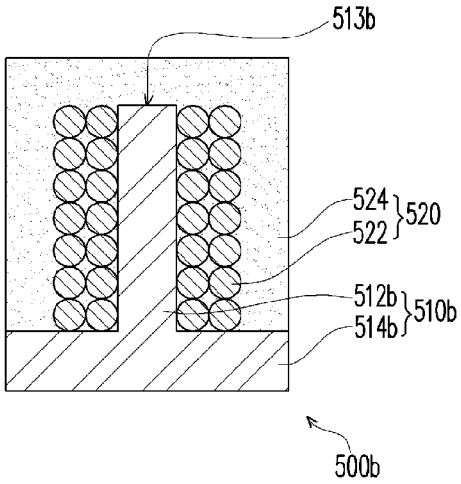
FIGS. 10A to 10D are schematic cross-sectional views of four variable structures of a core in FIG. 9.
Figure 10B:
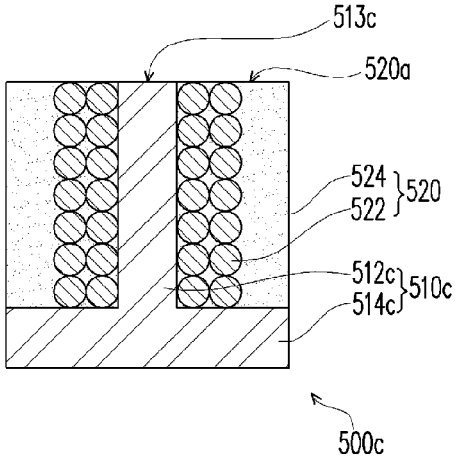
Figure 10C:
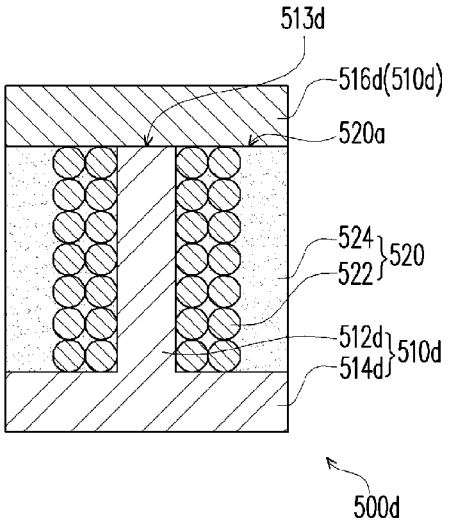
Figure 10D:
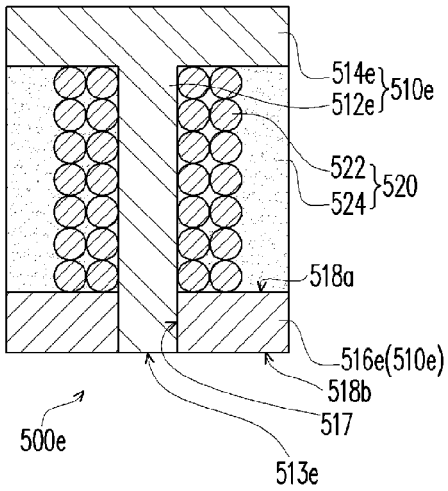

The structure of the core 510*a* is not limited to the structure disclosed in FIG. 9, and the core 510*a* may also adopt structures disclosed in FIGS. 10A to 10D. In particular, as shown in FIG. 10A, a core 510*b* of a choke 500*b* further includes a top plate 514*b*, the pillar 512*b* and the top plate 514*b* are integrally formed, and an end 513*b* of the pillar 512*b* is fitted in the package 520, i.e., the end 513*b* of the pillar 512*b* is not exposed outside the package 520, and a height of the package 520 is greater than a length of the pillar 512*b*. As shown in FIG. 10B, a core 510*c* of a choke 500*c* further includes a top plate 514*c*, a pillar 512*c* and the top plate 514*c* are integrally formed, and an end 513*c* of the pillar 512*c* passes through the package 520 and is substantially aligned with a surface 520*a* of the package 520 away from the top plate 514*c*. As shown in FIG. 10C, a core 510*d* of a choke 500*d* further includes a top plate 514*d* and a bottom plate 516*d*, the top plate 514*d* and the pillar 512*d* are integrally formed, an end 513*d* of the pillar 512*d* passes through the package 520 and is substantially aligned with a surface 520*a* of the package 520 away from the top plate 514*d*, and the bottom plate 516*d* covers an end 513*d* of the pillar 512*d* and the surface 520*a* of the package 520. As shown in FIG. 10D, a core 510*e* of a choke 500*e* further includes a top plate 514*e* and a bottom plate 516*e*, the top plate 514*e* and a pillar 512*e* are integrally formed, the bottom plate 516*e* has an opening 517, a joining face 518*a*, and an assembling face 518*b* opposite to the joining face 518*a*, an end 513*e* of the pillar 512*e* passes through the package 520 and is disposed in the opening 517 from the joining face 518*a*, and the 513*e* of the pillar 512*e* is substantially aligned with the assembling face 518*b*.

Figure 11A:
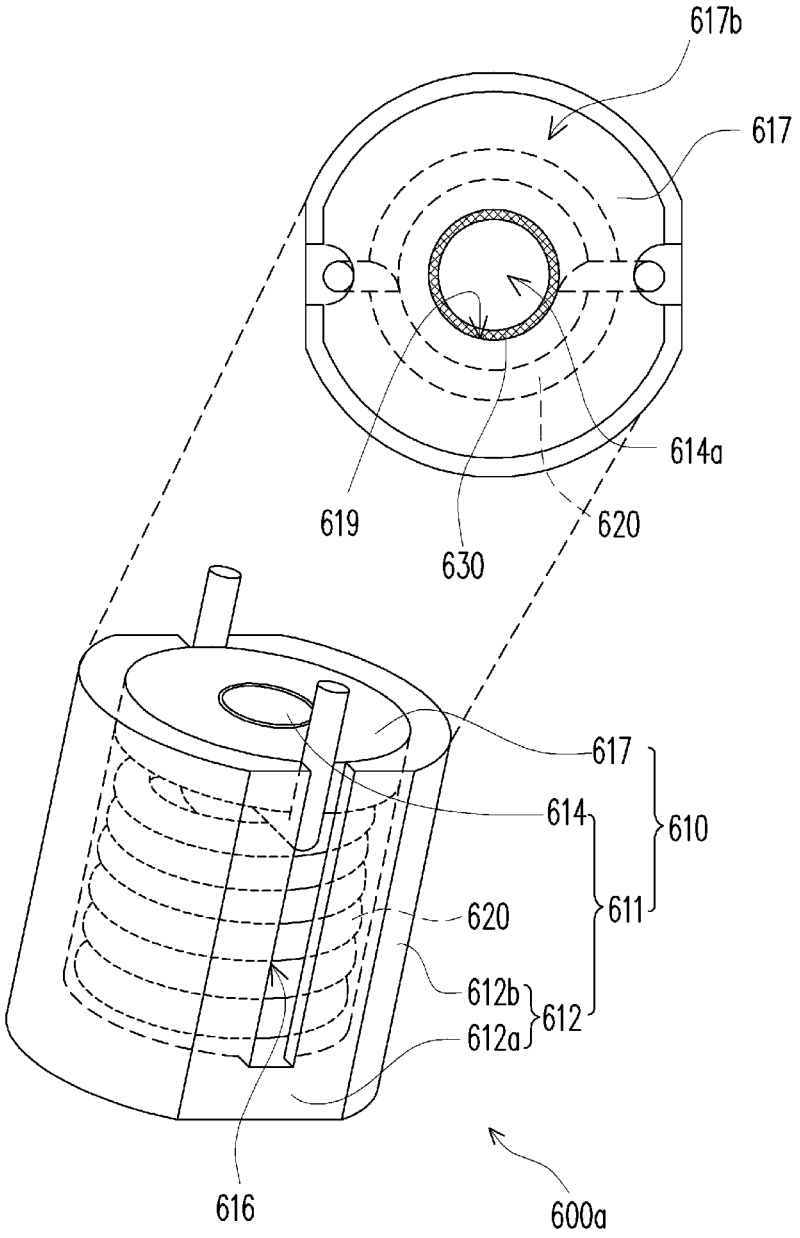
FIG. 11A is a schematic view of a choke according to another embodiment of the present invention.
Figure 11B:
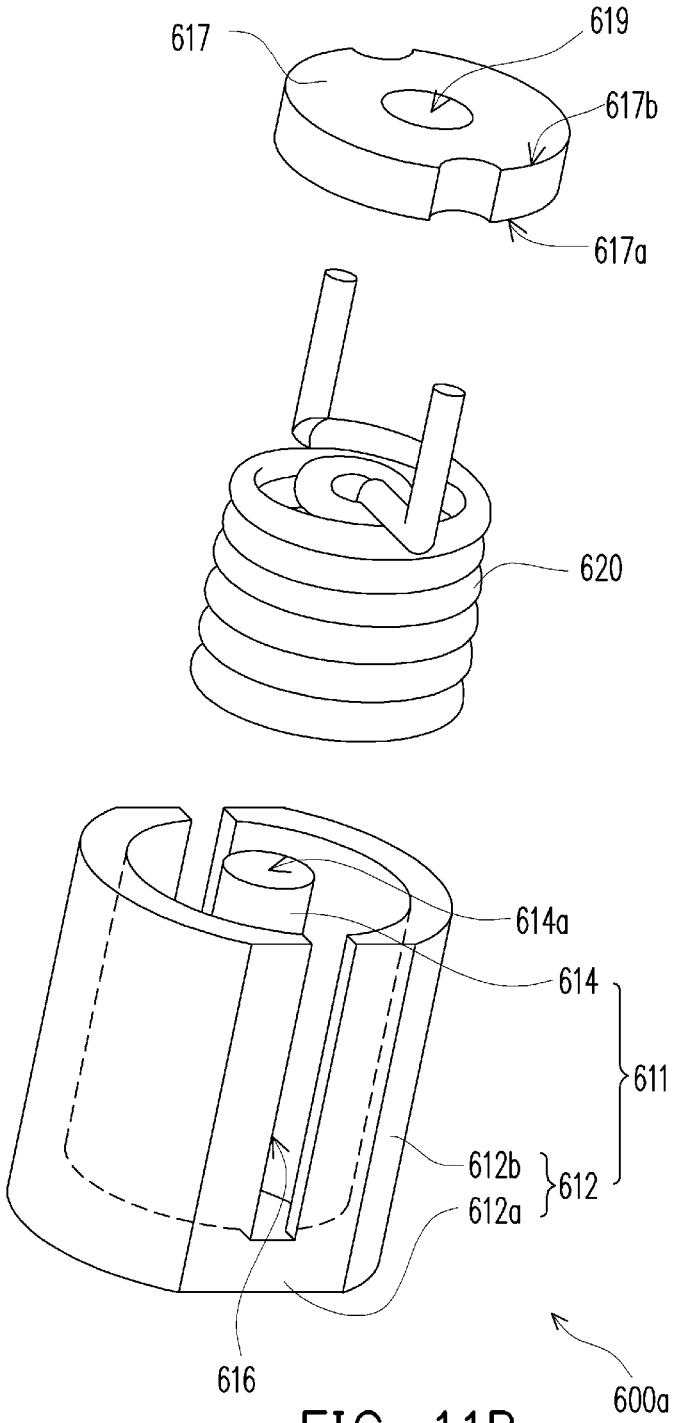
FIG. 11B is a schematic exploded view of the choke in FIG. 11A.

FIG. 11A is a schematic view of a choke according to another embodiment of the present invention, and FIG. 11B is a schematic exploded view of the choke in FIG. 11A. Referring to FIGS. 11A and 11B, in this embodiment, the choke 600*a* includes a core 610 and a hollow coil 620. In particular, the core 610 includes a first core body 611 and a second core body 617. The first core body 611 includes a top plate 612, a pillar 614, and at least one wire groove 616 (two wire grooves are shown in FIG. 11A). The pillar 614 and the top plate 612 are integrally formed. The top plate 612 has a bottom portion 612*a* and a side wall portion 612*b* disposed around the bottom portion 612*a*. The side wall portion 612*b* surrounds the pillar 614. A diameter of the pillar 614 is smaller than a length of one side of the bottom portion 612*a* in the top plate 612. An extension direction of the side wall portion 612*b* is substantially perpendicular to that of the bottom portion 612*a* and is parallel to that of the pillar 614. The wire grooves 616 are disposed at the side wall portion 612*b* of the top plate 612, and a width of the wire grooves 616 can be designed depending on a wire diameter of the disposed hollow coil 620.

The second core body 617 is a flat plate and has a joining face 617*a*, an assembling face 617*b* opposite to the joining face 617*a*, and an opening 619. The opening 619 is located at a center of the second core body 617 and in communication with the joining face 617*a* and the assembling face 617*b*. An end 614*a* of the pillar 614 is suitable to be disposed in the opening 619 from the joining face 617*a*. Particularly, a height of the side wall portion 612*b* of the top plate 612 may be the same as that of the pillar 614, and the second core body 617 is disposed surrounded by the side wall portion 612*b*. A material of the core 610 in this embodiment is the same as that of the core 310, and the details thereof will not be described herein again. In this embodiment, the pillar 614 is, for example, a cylinder, the second core body 617, the opening 619, and the bottom portion 612*a* of the top plate 612 are all, for example, in a round shape, and a diameter of the opening 619 is larger than or equal to that of the pillar 617.

The hollow coil 620 is fitted on the pillar 614 and located between the top plate 612 of the first core body 611 and the second core body 617. A height of the hollow coil 620 is smaller than that of the side wall portion 612*b* of the top plate 612. The side wall portion 612*b* at least contacts a part of the hollow coil 620. The fabrication method, material, and structure of the hollow coil 620 are the same as those of the hollow coil 320, and the details thereof will not be described herein again.

It should be noted that, the second core body 617 in this embodiment is directly press-fit on the hollow coil 620, so that the second core body 617 is directly disposed on the hollow coil 620, and the second core body 617 can be positioned according to the height of the hollow coil 620. In this embodiment, the end 614*a* of the pillar 614 of the first core body 611 is substantially aligned with the assembling face 617*b* of the second core body 617; however, in another embodiment, the end 614*a* of the pillar 614 of the first core body 611 may pass through the opening 619 of the second core body 617 and protrudes from the assembling face 617*b*, and a height of the pillar 614 protruding from the assembling face 617*b* is smaller than a length of two distal ends of the hollow coil 620 extending out of the wire grooves 616, which is still a technical solution applicable in the present invention without departing from the scope of the invention.

Further, in this embodiment, a material layer 630 may be selectively coated on a junction between the pillar 614 and the opening 619, so as to reduce the influence of the spacing between the pillar 614 and the opening 619 on the inductance value during the assembly. Besides, the material layer 630 is, for example, a resin gel or a magnetic gel. It is understood that, in an embodiment, a diameter of the pillar 614 of the first core body 611 is equal to that of the opening 619 of the second core body 617.

Figure 11C:
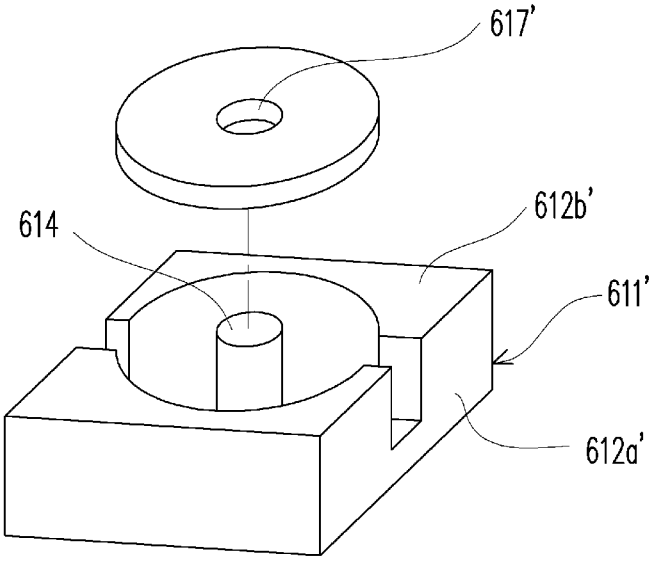
FIG. 11C is a schematic view of a choke according to another embodiment of the present invention.

In addition, the forms of the first core body 611 and the second core body 617 are not limited in the present invention. In this embodiment, the bottom portion 612*a* of the top plate 612 of the first core body 611 and the second core body 617 are both in a round shape; however, in another embodiment, referring to FIG. 11C, a bottom portion 612*a*' of a top plate 612' of a first core body 611' may also be rectangular, a side wall portion 612*b*' is disposed around the rectangular profile of the bottom portion 612*a*', and a second core body 617' is disposed in the side wall portion 612*b*' and is in a round shape, which is still a technical solution applicable in the present invention without departing from the scope of the invention.

In the choke 600*a* of this embodiment, the wire is first wound into the hollow coil 620 by using an automatic equipment, then the hollow coil 620 is fitted on the pillar 614 of the first core body 611, and the end 614*a* of the pillar 614 is disposed in the opening 619 of the second core body 617. Thereby, the hollow coil 620 is located between the top plate 612 of the first core body 611 and the second core body 617, and the assembly of the choke is completed. Compared with the conventional art, the choke 600*a* of this embodiment can not only effectively reduce the labor cost consumed in the winding process of the wire, but also enhance the assembly stability and reduce the inductance value variation by selectively coating the material layer 630 on the junction between the pillar 614 and the opening 619.

As in the choke 600*a* of this embodiment, the side wall portion 612*b* of the top plate 612 is adapted to replace the magnetic gel for encapsulating the hollow coil 620, so that the problem of overflow or vertical flow may not occur, and the process is simplified to lower the manufacturing cost. Further, different hollow coils can be applied by controlling a position of the second core body 617 relative to the first core body 611 so as to adjust the inductance, such that chokes having different inductances may use the same core, thereby saving the mold cost. Moreover, the opening 619 is disposed on the second core body 617 having the assembling face 617*b*, and thus the pillar 614 protrudes from the assembling face 617*b* without affecting the appearance of the choke 600*a* when the inductance value is adjusted through the position of the second core body 617.

Figure 11D:
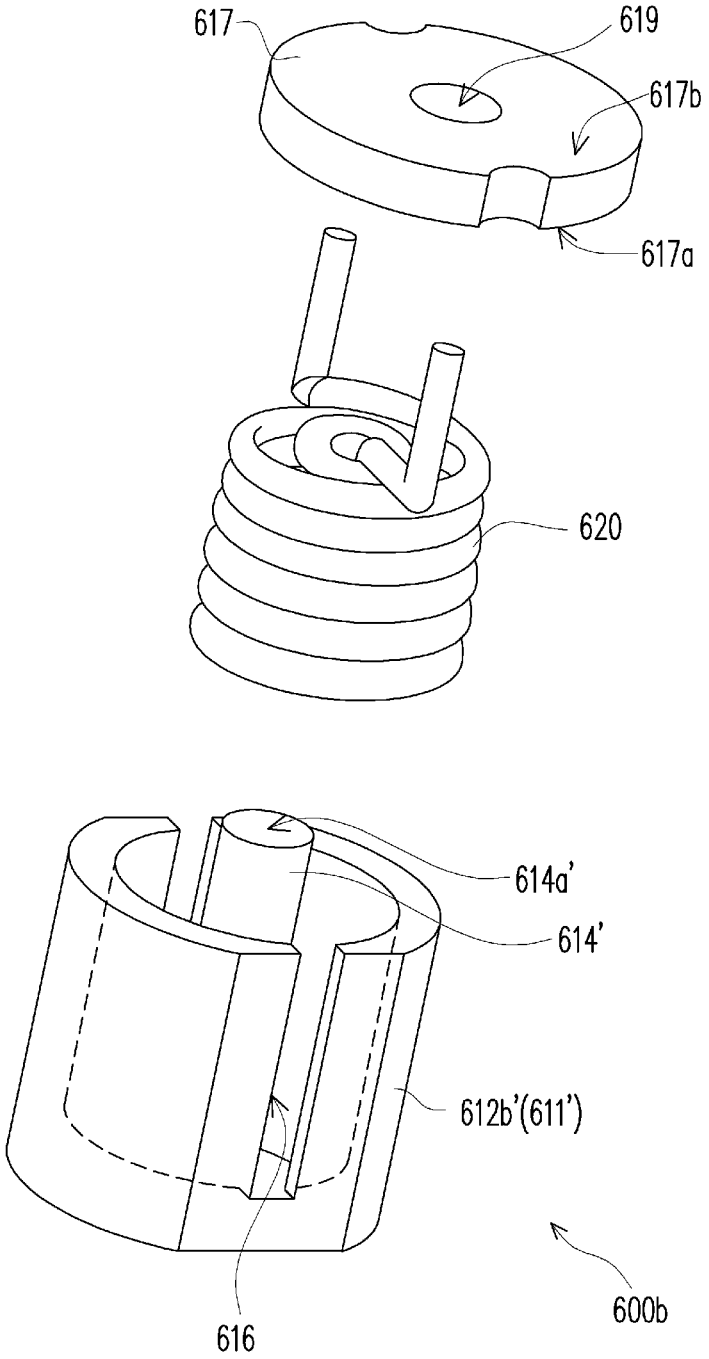
FIG. 11D is a schematic view of a choke according to another embodiment of the present invention.

In addition, FIG. 11D is a schematic cross-sectional view of a choke according to another embodiment of the present invention. Referring to FIGS. 11A and 11D, the choke 600*b* in FIG. 11D is similar to the choke 600*a* in FIG. 11A. The differences lie in that: a height of the side wall portion 612*b*' of the first core body 611' in a core 610' of the choke 600*b* in FIG. 11D is smaller than that of a pillar 614', an end 614*a*' of the pillar 614' is suitable to be disposed in the opening 619 from the joining face 617*a* of the second core body 617, and two ends of the second core body 617 are disposed on the side wall portion 612*b*', i.e., the second core body 617 can be positioned by the side wall portion 612*b*'. In this embodiment, the side wall portion 612*b*' is also adapted to replace the magnetic gel, so that the problem of overflow or vertical flow may not occur, and the process is simplified to lower the manufacturing cost.

The conventional choke 100 in FIG. 1 is compared with some of the chokes 300*a*, 300*c*, 300*d*, 600*a*, and 600*b* provided in the embodiments of the present invention through actually measured results.

[First Set of Actually Measured Results]

This actual measurement compares the conventional choke 100 with the choke 300*a* in FIG. 2A provided in the embodiment of the present invention, in which the cores are made of the same material and have similar volumes. Table 1 lists experimental data of the choke 100 and three identical chokes 300*a* obtained when an output of a power supply is in a range of 12 Volt to 5 Volt. Table 2 lists experimental data of the choke 100 and the three identical chokes 300*a* obtained when an output of the power supply is in a range of 12 Volt to 3.3 Volt.

TABLE 1

| | Efficiency (%) | | | |
|---|---|---|---|---|
| Current (Ampere, A) | Choke 100 | (a) Choke 300a | (b) Choke 300a | (c) Choke 300a |
| 1 | 86.76% | 91.92% | 91.16% | 92.31% |
| 2 | 92.13% | 94.06% | 94.66% | 94.78% |
| 3 | 94.08% | 95.86% | 95.77% | 95.82% |
| 4 | 94.88% | 96.26% | 96.12% | 96.33% |
| 10 | 94.92% | 95.64% | 95.49% | 95.41% |
| 20 | 91.97% | 91.93% | 92.26% | 92.29% |

TABLE 2

| | Efficiency (%) | | | |
|---|---|---|---|---|
| Current (Ampere, A) | Choke 100 | (a) Choke 300a | (b) Choke 300a | (c) Choke 300a |
| 1 | 87.22% | 88.78% | 88.30% | 88.64% |
| 2 | 92.45% | 93.23% | 93.13% | 93.12% |
| 3 | 94.02% | 94.63% | 94.47% | 94.50% |
| 4 | 94.24% | 95.06% | 94.99% | 94.90% |
| 10 | 93.73% | 93.92% | 93.92% | 93.81% |
| 20 | 89.47% | 89.62% | 89.59% | 89.53% |

It can be known from Tables 1 and 2 that, under the same current, the efficiencies of the chokes 300*a* are all higher than that of the conventional choke 100. In other words, the design of the core 310 of the choke 300*a* is better than that of the core of the conventional choke 100.

[Second Set of Actually Measured Results]

This actual measurement compares the conventional choke 100 with the choke 300*c* in FIG. 4 provided in the embodiment of the present invention, in which the cores are made of the same material and have similar volumes. Table 3 lists experimental data of the choke 100 and four identical chokes 300*c* obtained when an output of the power supply is in a range of 12 Volt to 5 Volt. Table 4 lists experimental data of the choke 100 and the four identical chokes 300*c* obtained when an output of the power supply is in a range of 12 Volt to 3.3 Volt.

TABLE 3

| | Efficiency (%) | | | | |
|---|---|---|---|---|---|
| Current (Ampere, A) | Choke 100 | (a) Choke 300c | (b) Choke 300c | (c) Choke 300c | (d) Choke 300c |
| 2 | 91.55 | 93.38 | 93.45 | 93.09 | 93.44 |
| 4 | 94.49 | 95.42 | 95.42 | 95.26 | 95.52 |
| 10 | 94.48 | 94.88 | 94.79 | 94.83 | 94.88 |
| 20 | 90.68 | 90.91 | 90.85 | 90.91 | 90.76 |

TABLE 4

| | Efficiency (%) | | | | |
|---|---|---|---|---|---|
| Current (Ampere, A) | Choke 100 | (a) Choke 300c | (b) Choke 300c | (c) Choke 300c | (d) Choke 300c |
| 2 | 88.25 | 90.40 | 90.33 | 90.01 | 90.37 |
| 4 | 92.28 | 93.30 | 93.34 | 93.20 | 93.47 |
| 10 | 92.39 | 92.78 | 92.75 | 92.69 | 92.79 |
| 20 | 87.80 | 87.80 | 87.89 | 88.05 | 88.01 |

It can be known from Tables 3 and 4 that, under the same current, the efficiencies of the chokes 300*c* are all higher than that of the conventional choke 100 at a light load (50% load).

[Third Set of Actually Measured Results]

This actual measurement compares the conventional choke 100 with the choke 300*d* in FIG. 5 provided in the embodiment of the present invention, in which the cores are made of the same material and have similar volumes. Table 5 lists experimental data of the choke 100 and the choke 300*d* obtained when an output of the power supply is in a range of 12 Volt to 3.3 Volt.

TABLE 5

| Efficiency (%) | | | | |
|---|---|---|---|---|
| | Current Ampere (A) | | | |
| | 2 A | 4 A | 10 A | 20 A |
| Choke 100 | 90.12 | 93.47 | 93.44 | 89.18 |
| Choke 300d | 93.55 | 95.34 | 94.33 | 88.72 |

It can be known from Table 5 that, under the same current, the efficiency of the choke 300*d* is higher than that of the conventional choke 100 at a light load.

[Fourth Set of Actually Measured Results]

In this actual measurement, experiments are carried out on the influence of a single-sided spacing at the junction between the pillar 312 and the opening 316 on an initial inductance of the choke 300*a*, and a thickness of the second core body 315 is 2.5 mm. Table 6 lists experimental data of the single-sided spacing vs. the initial inductance of the choke 300*a*.

TABLE 6

| Single-sided spacing (millimeter, mm) | Initial inductance (μH) | Inductance variation rate (%) |
|---|---|---|
| 0.001 | 7.41 | 0 |
| 0.1 | 6.89 | −6.91 |
| 0.2 | 6.56 | −11.38 |
| 0.3 | 6.31 | −14.78 |
| 0.4 | 6.11 | −17.51 |

It can be known from Table 6 that, when the single-sided spacing is 0.1 mm, the initial inductance decreases by 6.91%; and the larger the single-sided spacing is (for example, 0.4 mm), the greater the decease of the initial inductance will be (by 17.51%). That is, in the manufacturing process of the choke 300*a*, the spacing produced at the junction between the pillar 312 and the opening 316 may influence the inductance value variation.

Experiments are carried out on the influences of the material layer 340 filled at the junction between the pillar 312 and the opening 316 on the initial inductance of the choke 310*a*, and the thickness of the second core body 315 is 2.5 mm. Table 7 lists experimental data of the thickness of the material layer vs. the initial inductance.

TABLE 7

| Thickness of the material layer (millimeter, mm) | Initial inductance (μH) | Inductance variation rate (%) |
|---|---|---|
| 0.001 | 7.41 | 0 |
| 0.1 | 7.29 | −1.51 |
| 0.2 | 7.21 | −2.70 |
| 0.3 | 7.13 | −3.77 |
| 0.4 | 7.05 | −4.74 |

It can be known from Table 7 that, when the thickness of the magnetic material layer 330 is increased from 0.1 mm to 0.4 mm, the inductance variation rate is still lower than 5%. That is, compared with FIG. 18, the influence of the thickness of the material layer 330 on the initial inductance is smaller than that of the spacing produced at the junction between the pillar 312 and the opening 316 on the initial inductance. In other words, the inductance value variation caused by a process tolerance can be reduced by selectively filling the material layer 330.

Experiments are carried out with the thickness of the second core body 315 being 3 mm. Table 8 lists experimental data of the thickness of the material layer vs. the initial inductance.

TABLE 8

| Thickness of the material layer (millimeter, mm) | Initial inductance (μH) | Inductance variation rate (%) |
|---|---|---|
| 0.001 | 7.47 | 0 |
| 0.1 | 7.37 | −1.28 |
| 0.2 | 7.28 | −2.49 |
| 0.3 | 7.21 | −3.44 |
| 0.4 | 7.15 | −4.29 |

It can be known by comparing Table 8 and Table 7 that, when the thickness of the second core body 315 is increased from 2.5 mm to 3 mm, the inductance variation rate is only 0.81% higher than that of 2.5 mm, and when the thickness of the material layer 330 is 0.4 mm, the influence on the inductance is still lower than 5%. That is, coating the material layer 330 at the junction between the pillar 312 and the opening 316 has a greater influence on the inductance than increasing the thickness of the second core body 315.

[Fifth Set of Actually Measured Results]

This actual measurement simulates the influence of whether the choke 600*a* in FIG. 11A has wire grooves 616 or not on the inductance, and the wire diameter of the hollow coil 620 is 1 mm, the coil has 5.5 loops, and the DC impedance is 0.5 ohm. It can be known from the results of the simulation that, when the choke 600*a* does not have the wire grooves 616, the inductance is about 3.3 μH; and when the choke 600*a* has the wire grooves 616, the inductance is about 3.43 μH. That is, the inductance difference is 4% when the wire grooves 616 exist or not.

Then, experiments are carried out on the influence of the width of the wire groove 616 on the inductance, and the material of the first core body 611 of the choke 600*a* is FeAlSi alloy, and the magnetic permeability thereof is 125. Table 9 lists experimental data of the spacing of the wire grooves vs. the inductance.

TABLE 9

| Spacing of wire grooves (millimeter, mm) | Inductance (μH) | Inductance decrease rate (%) |
|---|---|---|
| 1.6 | 9.98 | 0.00 |
| 2.0 | 9.96 | 0.20 |
| 2.4 | 9.93 | 0.45 |
| 2.8 | 9.91 | 0.66 |
| 3.2 | 9.89 | 0.87 |
| 3.6 | 9.86 | 1.20 |
| 4.0 | 9.83 | 1.50 |
| 4.4 | 9.79 | 1.84 |
| 4.8 | 9.76 | 2.17 |

It can be known from Table 9 that, when the spacing of the wire grooves 616 is in a range of 1.6 mm to 4.8 mm, the inductance decrease rate of the choke 600*a* is below 3%. Thereby, the influence of the provision of the wire grooves 616 is small on the inductance.

[Sixth Set of Actually Measured Results]

Figure 12:
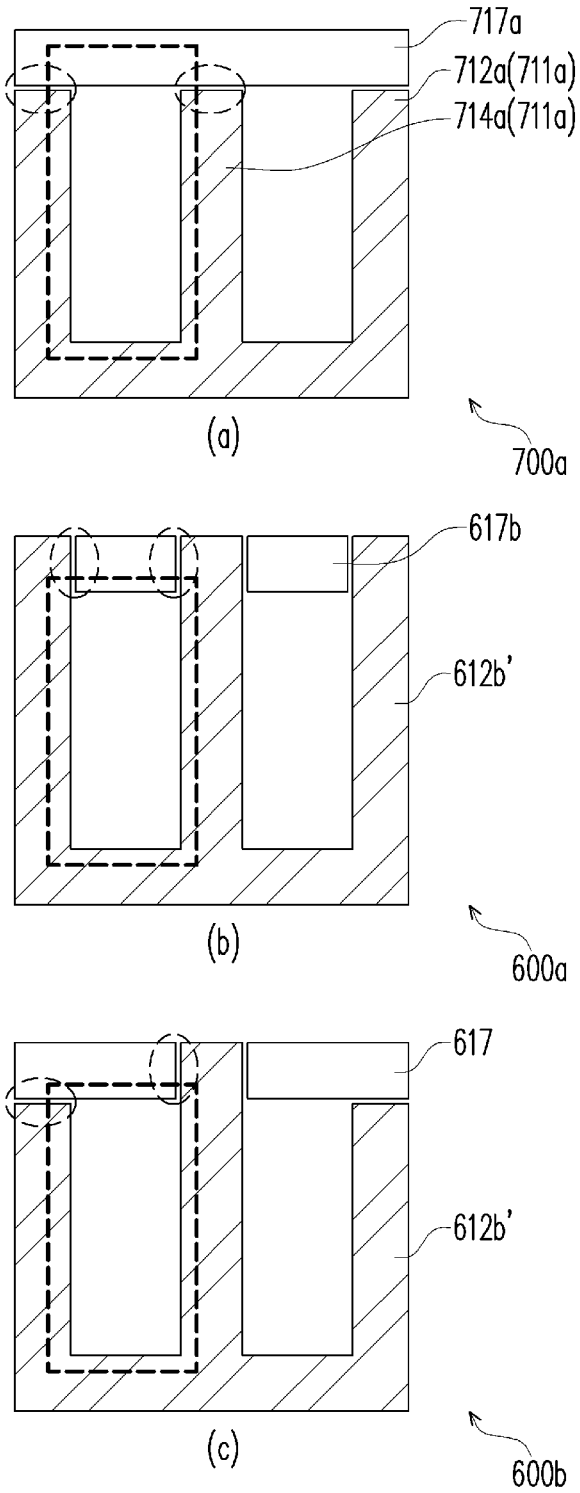
FIG. 12 is a schematic view of magnetic circuits of chokes.

Experiments of equivalent magnetic circuits are carried out on the choke 600*a* in FIG. 11A and the choke 600*b* in FIG. 11D, in which the cores of the chokes are made of the same material and have the same volume. FIG. 12 is a schematic view of the magnetic circuits of the chokes. For ease of illustration, FIG. 12 only shows the first core body and the second core body of each core. Specifically, FIG. 12(*a*) denotes that a second core body 717*a* is located on a pillar 714*a* and a side wall portion 712*a* of a first core body 711*a*, and the second core body 717*a* does not have an opening; FIG. 12(*b*) denotes the choke 600*a*, in which the second core body 617 is disposed surrounded by the side wall portion 612*b*; and FIG. 12(*c*) denotes the choke 600*b*, in which the two ends of the second core body 617 are disposed on the side wall portion 612*b*'. The thin dashed line represents a spacing (only a single-sided spacing is shown), and the thick dashed line represents a path of an equivalent magnetic circuit (only a single-sided path is shown). Table 10 lists experimental data of the single-sided spacing vs. the magnetic permeability of the equivalent magnetic circuit.

TABLE 10

| Single-sided spacing (millimeter, mm) | Magnetic permeability of the equivalent magnetic circuit | | |
|---|---|---|---|
| | (a) Choke 700a | (b) Choke 600a | (c) Choke 600b |
| 0 | 125 | 125 | 125 |
| 0.05 | 119.57 | 124.4 | 121.0 |
| 0.10 | 114.63 | 123.8 | 117.4 |
| 0.15 | 110.11 | 123.2 | 113.9 |
| 0.20 | 105.96 | 122.6 | 110.7 |
| 0.25 | 102.14 | 122.0 | 107.7 |
| 0.30 | 98.62 | 121.5 | 104.8 |
| 0.35 | 95.35 | 120.9 | 102.1 |
| 0.40 | 92.31 | 120.3 | 99.6 |

It can be known from Table 10 that, regarding the influence of the single-sided spacing on the magnetic permeability, the choke 600*a* is the smallest, the choke 600*b* is the next, and the choke 700*a* is the greatest. Thereby, the chokes 600*a* and 600*b* provided in the present invention may effectively reduce the influence of the single-sided spacing on the magnetic permeability, and accordingly have larger inductance values than the choke 700*a*.

In view of the above, the chokes 300*a*, 300*c* to 300*f*, 400*a* to 400*c*, 500*a* to 500*e*, 600*a*, and 600*b* provided by the present invention at least have the following advantages:

1. The assembly stability of the choke is high, and the inductance value variation is low.

2. The efficiency of the choke provided by the present invention is higher than that of the conventional choke.

3. A wire can be wound into a hollow coil by using an automatic equipment, thereby effectively reducing the labor cost consumed in the winding process of the wire.

4. Different coils can be applied by controlling a position of the second core body relative to the first core body so as to adjust the inductance, such that chokes having different inductances may use the same core, thereby saving the mold cost.

5. When the choke has wire grooves, an appearance width of the choke is effectively reduced, a distance between the end portions of the coil is narrowed, and a pad pitch on a circuit board is also decreased.

6. An opening is disposed on the second core body or bottom plate having an assembling face, so that the pillar protrudes from the assembling face without affecting the appearance of the choke.

7. The choke has a case, a package, and a magnetic case or a core with side wall portions, in which each can be used to replace a magnetic gel, thereby effectively avoiding the problem of overflow or vertical flow of the magnetic gel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method to form a choke, comprising:

encapsulating a hollow coil without a bobbin by a molding body comprising a magnetic material;

forming a first core, wherein the first core comprises a pillar; and disposing at least a first portion of the pillar inside the encapsulated hollow coil.

2. The method according to claim 1, wherein the molding body has a top surface and a bottom surface, wherein the hollow coil is disposed between the top surface and the bottom surface of the molding body.

3. The method according to claim 1, wherein the molding body is formed by injecting the magnetic material to the hollow coil to encapsulate the hollow coil.

4. The method according to claim 1, wherein the molding body is formed by pressing the magnetic material to the hollow coil to encapsulate the hollow coil.

5. The method according to claim 1, wherein encapsulating the hollow coil by the molding body comprises: forming the molding body; and disposing the hollow coil inside the molding body.

6. The method according to claim 1, wherein the first core further comprises a top portion, wherein the pillar has a top end and a bottom end, wherein the top portion is connected to the top end of the pillar and at least one portion of the top portion is disposed on the top surface of the molding body.

7. The method according to claim 6, further comprising: forming a second core, wherein the second core has an opening; and disposing a second portion of the pillar in the opening of the second core and connecting the second portion of the pillar to the second core.

8. The method according to claim 7, wherein the second core comprises a joining face and an assembling face opposite to the joining face, and the bottom end of the pillar is disposed in the opening via the joining face.

9. The method according to claim 6, wherein the top portion of the first core and the pillar are integrally formed.

10. The method according to claim 6, wherein the top portion of the first core is a top plate and the hollow coil is located between the top plate of the first core and the second core.

11. The method according to claim 7, wherein the second core is directly disposed on the hollow coil.

12. The method according to claim 8, wherein the bottom end of the pillar is substantially aligned with the assembling face.

13. The method according to claim 8, wherein the hollow coil comprises two end portions disposed on the assembling face; and the second core further comprises two wire grooves located at edges of the second core, and the end portions pass through the wire grooves.

14. The method according to claim 7, further comprising a material layer disposed on an inner wall of the opening and located between the pillar and the opening.

15. The method according to claim 14, wherein the material layer is made of magnetic gel.

16. A method to form a choke, comprising:

forming a molding body;

disposing a hollow coil inside the molding body to encapsulate the hollow coil;

forming a first core, wherein the first core comprises a pillar; and disposing at least a first portion of the pillar inside the encapsulated hollow coil, wherein the molding body is a barrel-shaped case, wherein at least one portion of the first core and the hollow coil are disposed in the barrel-shaped case.

17. The method according to claim 16, wherein a magnetic gel is disposed in a space between the barrel-shaped case and the hollow coil.

18. A method to form a choke, comprising:

encapsulating a hollow coil by a molding body;

forming a first core, the first core comprising a pillar and a top portion, wherein the pillar has a top end and a bottom end, wherein the top portion is connected to the top end of the pillar;

disposing at least a first portion of the pillar inside the encapsulated hollow coil, wherein at least one portion of the top portion of the first core is disposed on the top surface of the molding body;

forming a second core, wherein the second core has an opening; and disposing a second portion of the pillar in the opening of the second core and connecting the second portion of the pillar to the second core, wherein the second core comprises a joining face and an assembling face opposite to the joining face, and the bottom end of the pillar is disposed in the opening via the joining face.

19. The method according to claim 18, wherein the bottom end of the pillar is substantially aligned with the assembling face of the second core.

20. The method according to claim 18, wherein the hollow coil comprises two end portions disposed on the assembling face of the second core; and the second core further comprises two wire grooves located at edges of the second core, and the two end portions of the hollow coil pass through the two wire grooves, respectively.

* * * * *